US006086105A

United States Patent [19]

Woldenberg et al.

[11] Patent Number: 6,086,105

[45] Date of Patent: Jul. 11, 2000

[54] BOOK FOR PACKAGING ACTIVITY PIECES IN AN ACTIVITY KIT

[75] Inventors: Richard Woldenberg, Highland Park; Lisa Hoffman, Mt. Prospect, both of Ill.

[73] Assignee: Learning Resources, Inc., Vernon Hills, Ill.

[21] Appl. No.: 08/949,547

[22] Filed: Oct. 14, 1997

[51] Int. Cl.[7] ..... B42D 3/00

[52] U.S. Cl. ..... 281/31; 281/37; 281/29; 402/70

[58] Field of Search ..... 281/37, 31, 29, 281/21.1, 22; 206/232, 461, 467; 402/70, 73

[56] References Cited

U.S. PATENT DOCUMENTS

| | | | |
|---|---|---|---|
| 1,787,569 | 1/1931 | Deutschmeister | 206/232 |
| 1,890,988 | 12/1932 | Harden | 206/232 |
| 4,752,003 | 6/1988 | Miller et al. | 206/232 |
| 5,161,907 | 11/1992 | Byrne | 281/31 |
| 5,484,054 | 1/1996 | Kryszewski | 206/307.1 |
| 5,575,384 | 11/1996 | Saye | 206/232 |
| 5,704,472 | 1/1998 | Werner et al. | 206/232 |
| 5,772,247 | 6/1998 | Legrand | 281/31 |
| 5,850,914 | 12/1998 | Patterson et al. | 281/29 |

OTHER PUBLICATIONS

Photograph of *The Offical Icky Poo Book,* published by Klutz Press, Palo Alto California, 1990.

Photograph of *Bears! Bears! Bears!,* published by Addison–Wesley Publishing co., Reading, Massachusetts in 1996.

Photograph of *Money Madness,* published by Addison–Wesley Publishing Co., Reading, Massachusetts in 1995.

Photograph of *Rhye and Roll dice,* published by Judy/Instructo Parsippany, New Jersey in 1996.

*Primary Examiner*—Willmon Fridie, Jr.

*Attorney, Agent, or Firm*—Larry E. Saret; Rita A. Abbati; Laff, Whitesel & Saret, Ltd.

[57] ABSTRACT

A clamshell blister package permits packaging of activity pieces with a book in an activity kit. The package is reclosable and see-through and extends through and is connected to the cover for holding the activity pieces such that the package may be removed (and later replaced) so as not to interfere with the pages when the book is being used. The package is configured to friction fit into an aperture in the front cover of the book so that the package can be removed and reinstalled into the cover. The package includes a top and a bottom connected together by a hinge. The bottom includes an integrally formed platform which releasably engages a ledge and ledge wall of the top for holding the top closed onto the bottom in a reclosable fashion. The top defines a receptacle into which the activity pieces are stored when not in use, within or outside the book.

17 Claims, 2 Drawing Sheets

BOOK FOR PACKAGING ACTIVITY PIECES IN AN ACTIVITY KIT

FIELD OF THE INVENTION

The present invention relates generally to books including packaging for activity pieces sold with the books. More particularly, the present invention relates to a book with a clamshell blister package incorporated into the front cover of the book for holding activity pieces.

BACKGROUND INFORMATION

Workbooks have long been used to supplement and enhance education. Typical workbooks include pen and pencil drills in which the child completes a learning activity by writing on a page of the workbook. However, these workbooks are not reusable because the pages of the workbook are unusable after the child writes on them to complete the activity.

Another learning tool is activity kits which include an activity book and activity pieces. These activity kits provide an interactive, hands-on learning environment for the child. Generally, the child completes a learning activity by arranging or selecting appropriate activity pieces from the group of activity pieces in accordance with instructions in the book, using the activity pieces together with printed material or by playing a game with the activity pieces. These activity kits are typically reusable since the pages are not written upon and the activity pieces are not destroyed by the child completing the learning activity.

A challenge for the manufacturers of activity kits is to package the activity pieces with the activity book in such a way to facilitate the unencumbered use of each page of the book. Publishers are plagued by practical problems such as (a) providing a resealable and reusable container for the activity pieces which can be stored conveniently with the book, (b) packaging the activity pieces with the book in such a way to avoid losing print area or otherwise impairing the publisher's design freedom on interior pages and (c) preserving the ability to use each side of each interior page for activities involving activity pieces. The latter problem has been particularly difficult to resolve for permanent containers adhered to the book cover because as the book is opened to interior activity pages, the protruding container distorts the plane of the cover surface, preventing it from lying flat, and tends to render a level surface impossible to obtain. Without a level surface, important and basic activities such as gameboards and puzzles cannot be used effectively.

One example of an activity kit combining a book with activity pieces is *The Official Icky Poo Book* published by Klutz Press of Palo Alto, Calif. This kit includes a book and activity pieces. The activity pieces are held in a plastic bag which is attached to the book by a cable tie strap secured through a hole punched in the top cover of the book nearest to the book binding. The cable tie cannot be reattached once it is broken to provide access to the bag's contents.

An activity kit entitled *Bears! Bears! Bears!* published by Addison-Wesley Publishing Company of Reading, Mass. includes a spiral bound book with a plastic carrying case on top of, but separate from, the book cover. The carrying case includes activity pieces and is removably secured to an elongated flap bound to the spiral binding. The carrying case comprises a top and bottom hingedly secured together. The bottom includes a ridge which defines a receptacle and a plurality of integrally formed posts formed on an elongated flange which extends from one side of the receptacle. The top comprises an inner edge which mates with the ridge to close the receptacle and a plurality of caps on an elongated flange which mate with the posts. The flap includes a plurality of apertures. In order to secure the package to the book, the posts are inserted through the flap apertures and frictionally secured in the caps, thereby locking the flap between the top flange and the bottom flange. The package can be removed from the flap by removing the posts from the caps and flap apertures.

The activity kit entitled *Money Madness,* also published by Addison-Wesley Publishing Company incorporates the activity piece packaging into the cover of the activity book. The cover essentially comprises a two ply sheet material in which the activity pieces are sealed between the material pieces. The top ply includes a see-through window and the bottom ply includes an opening adjacent to the window. The two plies of material are sealed together around the perimeter of the window to form a pocket substantially coplanar with the cover for holding the activity pieces. Once the activity pieces are placed in the pocket, an adhesive label is applied over the bottom ply opening to seal the pocket shut. To access the activity pieces, the adhesive label must be peeled away and is generally not reusable.

An activity kit entitled *Rhyme and Roll Dice* published by Judy/Instructo of Parsippany, N.J. includes an activity book having a package for holding activity pieces. The package is attached to the inside back cover of the book and extends up past the front cover through an aperture in each page in the book. The package is resealable and includes a bottom permanently adhered to the inside of the back cover of the book and a top hingedly attached to the bottom. The bottom includes an upstanding portion which frictionally engages the inside wall of a blister formed in the top, thereby holding the top closed onto the bottom. The activity pieces are held inside the blister portion of the package.

While the above-mentioned devices may work for their intended purposes, they all complicate construction of the book, and none of these devices provide a resealable container built into the cover of a book which does not interfere with the pages of the book when opened for use. It is thus apparent that there is a need for an improved means for simply packaging activity pieces with a book in an activity kit.

An object of the present invention is to provide an improved means for simply packaging activity pieces with a book in which the packaging is resealable, is connected to the book cover but is removable without damage to the cover and does not interfere with the pages of the book.

SUMMARY OF THE INVENTION

These needs and other needs are satisfied by the activity book with a clamshell blister package of the present invention. The clamshell blister package of the present invention allows the activity book and activity pieces of the present invention to be stored together on a shelf like a regular book. The activity book and activity pieces can be reused together as a complete activity kit for facilitating hands-on learning.

The activity kit comprises a book and a plurality of activity pieces. The book includes a plurality of pages and a cover covering the pages. A reclosable, see-through package extends through and is connected to the cover for holding the activity pieces such that the package does not extend through or otherwise interfere with the pages when the book is being used. The package is preferably built into the front cover of the book so that the activity pieces are clearly visible when the book is displayed.

In the preferred embodiment, the package has a clamshell configuration comprising a top and a bottom connected together by a hinge. The top includes a ledge and ledge wall which engages a platform of the bottom for holding the top closed onto the bottom. The top further includes a receptacle into which the activity pieces are stored when not in use.

The package is configured to fit into an aperture in the front cover of the book. The package is friction fit into the cover so that the package can be removed and reinstalled into the cover without damage to the cover. Alternatively, reusable adhesive tape, glue, rubber cement or a hook and loop type fastener can be included to further secure the package in the cover aperture. Adhesive tape would also further hold the package top closed on the package bottom.

Further objects, features and advantages of the present invention will become apparent from the following description and drawings.

DETAILED DESCRIPTION OF THE INVENTIONS

In accordance with the present invention, a workbook with clamshell blister package for holding activity pieces provides distinct advantages when compared to those of the prior art. The invention can best be understood with reference to the accompanying drawing figures.

Figure 1:
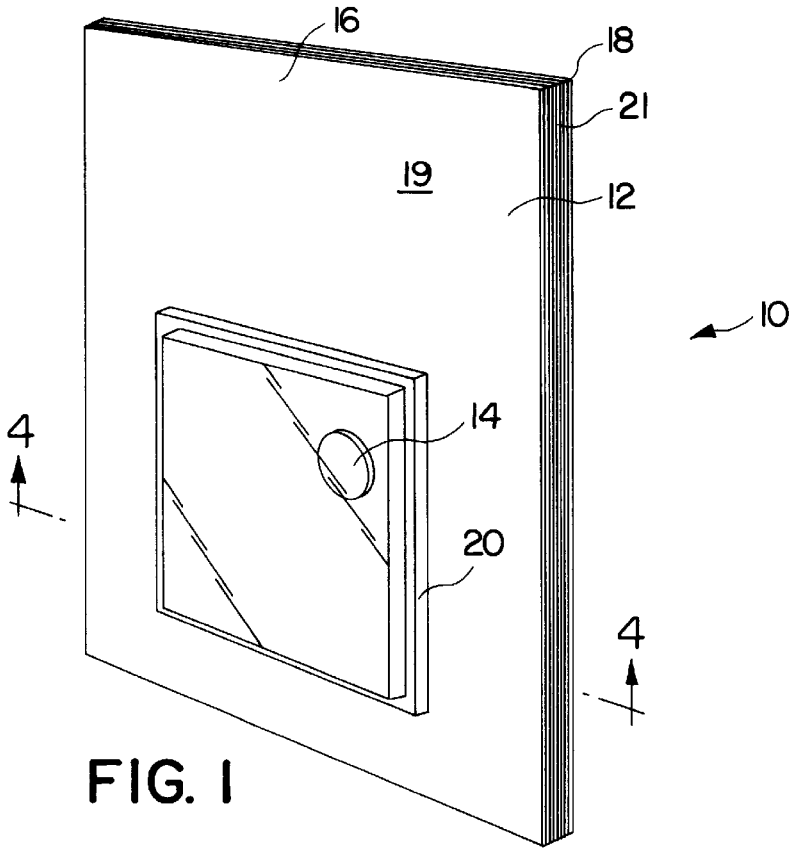
FIG. 1 is a front perspective view of the activity kit according to the present invention.
Figure 2:
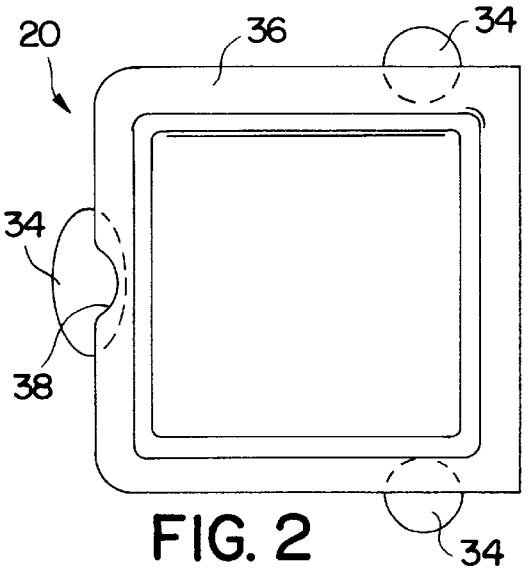
FIG. 2 is a plan view of the package of the activity kit of FIG. 1.
Figure 3:
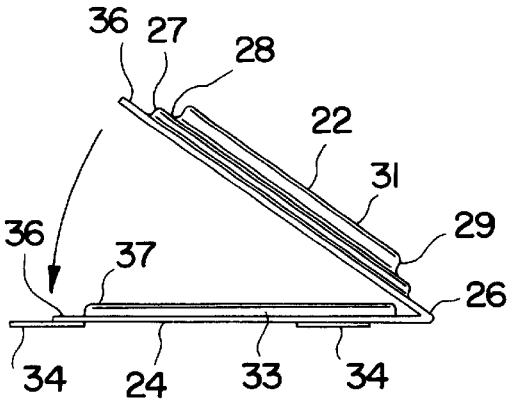
FIG. 3 is an elevation view of the package of FIG. 2.
Figure 4:
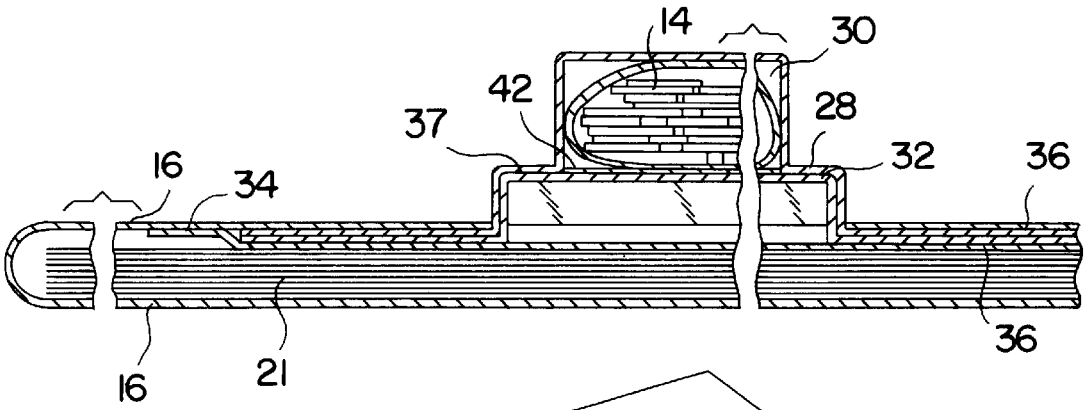
FIG. 4 is a sectional view of the package and activity book taken along line 4—4 of FIG. 1.
Figure 5:
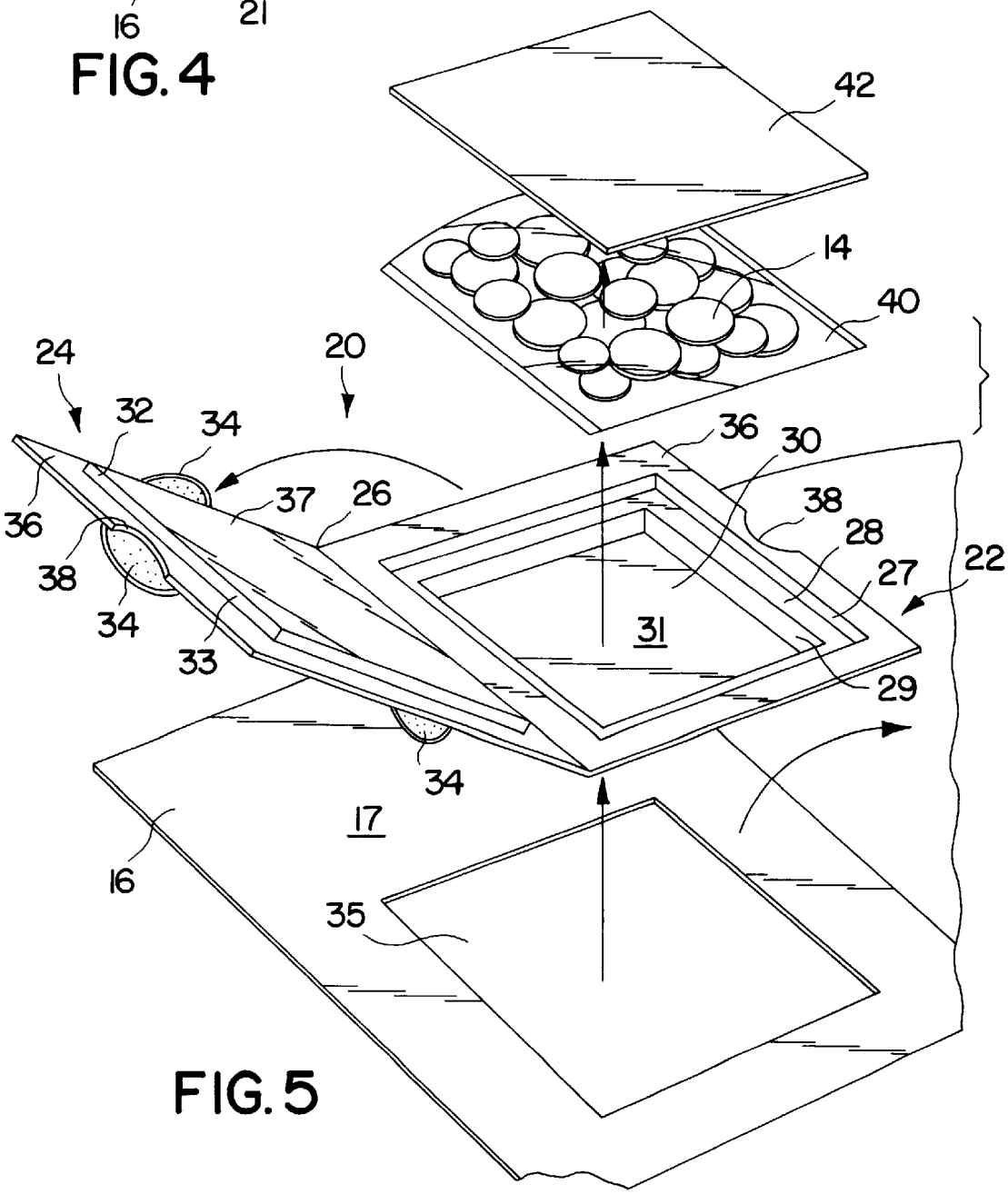
FIG. 5 is an exploded view of the packaging and cover of the activity kit of FIG. 1.

Referring now to FIG. 1, the activity kit, generally indicated at 10, comprises a book 12, package 20, and activity pieces 14. The book 12 comprises a front cover 16, a back cover 18 and a plurality of pages 21 with front and back sides. Front cover 16 has an inner surface 17 that faces pages 21 and an oppositely disposed outer surface 19. The activity pieces 14 are held in package 20, which is built into the front cover 16.

As best shown in FIGS. 2–5, the package 20 comprises a top 22 and a bottom 24. The package 20 is formed in a clamshell configuration with the top 22 connected to the bottom 24 by a hinge 26. The top 22 includes a ledge 28 bordering a cavity or receptacle 30 which is formed in top 22 and defined by receptacle wall 29 and receptacle top 31, for holding the activity pieces 14. The ledge 28 is surrounded by a ledge wall 27.

The bottom 24 includes a platform 32 and a platform wall 33 planar surface 37 meeting platform wall 33 at generally right angles. Planar surface 37 frictionally engages ledge 28 in the top 22 and platform wall 33 frictionally engages ledge wall 27 in top 22 to hold the bottom 24 to the top 22. Thus, the recloseable receptacle 30 is defined by platform 32 on the bottom, receptacle wall 29 on the sides, and receptacle top 31 on top. Reusable adhesive tape 34 can optimally be provided for further holding the bottom 24 to the top 22, particularly during shipment and through point of sale, when inadvertent separation of the package 20 and cover 16 may occur. Alternatively, glue, rubber cement, or a hook and loop type fastener may be used in place of or in addition to the reusable adhesive tape 34.

The package 20 is friction fit into an aperture 35 in the front cover 16 such that the receptacle 30 extends through and above the front cover 16. The top 22 and bottom 24 both include flanges 36. The flanges 36 engage the border of the aperture 35, preferably on the inside surface 17 of cover 16, to frictionally hold the package 20 in the aperture 35. Additional reusable adhesive tape, glue, rubber cement, or a hook and loop type fastener (not shown) can be provided for temporarily further securing the package 20 in the front cover aperture 35 to prevent inadvertent separation of the package 20 and cover 16 during shipment or retail sale. The tape 34 also has the effect of assuring that the package 20 is kept closed, which retailers require to keep the product in saleable condition. Once the activity kit 10 is purchased, this tape 34 is generally unnecessary because the friction fit is generally sufficient to hold the package 20 within the cover 16. The flanges 36 include opening tabs 38 for facilitating opening of the package 20.

When the package 20 is installed in the front cover 16, the ledge 28 is above the flange 36 on bottom 24 such that the ledge 28 is approximately flush or coplanar with the top of the front cover 16. The receptacle 30 extends upwardly from the ledge 28 such that its contents can be plainly seen above the front cover 16 in a configuration typically referred to as a blister package.

Since the package 20 is held in the front cover 16, the package 20 does not interfere with the print area of the pages 21 of the book 12. Furthermore, since the package 20 is friction fit into the aperture 35 of the front cover 16, the package 20 can be removed and reinstalled into the front cover 16 without damage to the cover. This allows the user to store the activity pieces 14 in the package 20, even with the package 20 removed from the front cover 16. The user can also use the activity pieces 14 without interfering with the pages 21 of the book 12 and without creating an uneven playing surface caused by the package 20 protruding from the planar surface of the book cover 16.

Preferably, the receptacle 30 is made of a see-through material, such as clear plastic, so that the activity pieces 14 are clearly visible when the activity book 12 is displayed.

When packaged for distribution, the activity pieces 14 can be enclosed in a resealable bag 40, which is housed in package 20. A package backing 42 can also be included for providing a colorful background or descriptive information viewable through the see-through package 20. Preferably, the background is configured to match or blend with the front cover design to provide the illusion that the package 20 extends from, but not through, the front cover 16.

It will be apparent to those skilled in the art that modifications may be made without departing from the spirit and scope of the invention, Accordingly, it is not intended that the invention be limited except as may be necessary in view of the appended claims.

What is claimed is:

1. A book comprising:

at least one page having a print area;

a cover for covering said page, said cover having an outer surface and an inner surface;

an aperture formed in said cover and defined by a border;

a recloseable, see-through package comprising a receptacle and at least one flange, said flange extending around said receptacle, said package extending through and connected to said cover for holding an activity piece such that said package does not reduce said print page area, wherein the flange of said package engages said inside surface of the cover adjacent said border.

2. The book of claim 1 wherein said package does not extend through said page.

3. The book of claim 1 wherein said page has a front side and a back side and said cover is a front cover for covering said front side of said page.

4. The book of claim 3 wherein said package further comprises a platform formed on said bottom and a ledge and ledge wall formed on said top, said platform engaging said ledge and ledge wall for holding said top closed on said bottom.

5. The book of claim 1 wherein said package is removable from said cover and replaceable into said cover.

6. The book of claim 5 wherein said package is friction fit into an aperture in said cover.

7. A book comprising:

at least one page having a front side and a back side;

a front cover for covering said front side of said package, said front cover having an outer surface and an inner surface;

an aperture formed in said front cover;

a recloseable, removable, see-through package comprising a receptacle and at least one flange, said flange extending around said receptacle, said package extending through and connected to said front cover, wherein the flange of said package engages said inside surface of the cover adjacent said border, said package defining a hollow receptacle, and wherein said package is friction fit into said aperture formed in said front cover.

8. The book of claim 7 wherein said package further comprises friction-fit means formed on said top and bottom for holding said top closed on said bottom.

9. The book of claim 7 wherein said package extends above and through said cover but not through said page.

10. An activity kit comprising:

at least one page having a print area;

a cover for covering said page, said cover having an outer surface and an inner surface;

an aperture formed in said cover and defined by a border;

a recloseable, see-through package comprising a receptacle and at least one flange, said flange extending substantially around said receptacle, said package extending through and connected to said cover for holding an activity piece such that said package does not reduce said print page area, wherein the flange of said package engages said inside surface of the cover adjacent said border.

11. An activity kit according to claim 10 wherein said package does not extend through said page.

12. The activity kit of claim 10 wherein said page has a front side and a back side and said cover is a front cover for covering said front side of said page.

13. The activity kit of claim 10 wherein said package further comprises a platform formed on said bottom for frictionally engaging said top and holding said top closed on said bottom.

14. The activity kit of claim 10 wherein said package is removable from said cover and replaceable back into said cover.

15. The activity kit of claim 14 wherein said package is friction fit into an aperture in said cover.

16. The book of claim 4 wherein said platform formed in the bottom of said package comprises a planar surface and a platform wall.

17. The book of claim 16 wherein said planar surface of said platform engages said ledge and said platform wall engages said ledge wall.

* * * * *

UNITED STATES PATENT AND TRADEMARK OFFICE

CERTIFICATE OF CORRECTION

PATENT NO. : 6,086,105
DATED : July 11, 2000
INVENTOR(S) : Richard Woldenberg, Lisa Hoffman It is certified that error appears in the above-identified patent and that said Letters Patent is hereby corrected as shown below:

Column 5,
Line 18, delete "package" and insert -- page --
Line 27, delete "border" and insert -- aperture --

Signed and Sealed this

Eighteenth Day of December, 2001

*Attest:*

*Attesting Officer*

JAMES E. ROGAN
*Director of the United States Patent and Trademark Office*